US006085380A

United States Patent [19]

Gonda et al.

[11] Patent Number: 6,085,380

[45] Date of Patent: Jul. 11, 2000

[54] BATHING IMPLEMENT CONSTRUCTED OF LOOPED FILAMENTS

[75] Inventors: Frank Gonda, Fairfield, Conn.; Edward John Giblin, Finksburg, Md.; Christopher John Brooks, Glen Head; James Troy Collins, New York, both of N.Y.

[73] Assignee: Lever Brothers Company, Division of Conopco, Inc., New York, N.Y.

[21] Appl. No.: 08/934,992

[22] Filed: Sep. 22, 1997

[51] Int. Cl.[7] ..... A46B 3/22

[52] U.S. Cl. ..... 15/207.2; 15/160; 15/188; 15/209.1; 15/226; 206/77.1

[58] Field of Search ..... 206/77.1; 473/614; 401/196, 268; 15/104.93, 104.94, 160, 188, 210.1, 226, 209.1, 207.2

[56] References Cited

U.S. PATENT DOCUMENTS

| | | | |
|---|---|---|---|
| D. 317,489 | 6/1991 | Stillinger | D21/707 |
| 574,449 | 1/1897 | Pritschau | 51/299 |
| 1,047,703 | 12/1912 | Rapson | 15/226 |
| 1,179,426 | 4/1916 | Hamilton | 15/207.2 |
| 1,537,425 | 5/1925 | Farwell | 15/188 |
| 1,991,559 | 2/1935 | Kingman | 510/439 |
| 2,026,638 | 1/1936 | Kingman | 451/461 |
| 2,581,779 | 1/1952 | Abraham | 15/229.11 |
| 2,599,191 | 6/1952 | Meunier | 15/207.2 |
| 2,654,191 | 10/1953 | Pusch | 15/118 |
| 2,817,865 | 12/1957 | Arioli | 401/201 |
| 3,103,031 | 9/1963 | Winston | 15/104.93 |
| 3,146,479 | 9/1964 | Stoker | 15/118 |
| 3,165,776 | 1/1965 | Tuseth | 15/167.1 |
| 3,226,751 | 1/1966 | Lemelson | 15/118 |
| 3,254,357 | 6/1966 | Caul et al. | 15/118 |
| 3,281,884 | 11/1966 | Feil | 15/244.1 |
| 3,345,668 | 10/1967 | Forrest | 15/229.11 |
| 3,414,928 | 12/1968 | Lemelson | 15/118 |
| 3,634,901 | 1/1972 | Landsberg | 15/118 |
| 3,853,412 | 12/1974 | Griffin | 15/167.1 |
| 4,027,352 | 6/1977 | Wagner | 15/229 |
| 4,030,845 | 6/1977 | Deckert | 15/167.1 |
| 4,091,490 | 5/1978 | Allen | 15/226 |
| 4,154,542 | 5/1979 | Rasmason | 401/7 |
| 4,190,550 | 2/1980 | Campbell | 15/104.93 |
| 4,199,835 | 4/1980 | Heyer et al. | 15/229.11 |
| 4,214,341 | 7/1980 | Rath | 15/210.1 |
| 4,343,061 | 8/1982 | Hanazono | 15/244.3 |
| 4,406,032 | 9/1983 | Diamant | 15/207.2 |
| 4,462,135 | 7/1984 | Sanford | 15/105 |
| 4,606,964 | 8/1986 | Wideman | 428/152 |
| 4,616,374 | 10/1986 | Novogrodsky | 15/207.2 |
| 4,756,529 | 7/1988 | Stillinger | 473/614 |
| 4,927,141 | 5/1990 | Paranto | 473/413 |
| 4,969,225 | 11/1990 | Schubert | 15/229.12 |
| 4,980,943 | 1/1991 | Barber | 15/227 |
| 5,144,744 | 9/1992 | Campagnoli | 29/446 |
| 5,295,280 | 3/1994 | Hudson et al. | 15/222 |
| 5,412,830 | 5/1995 | Girardot et al. | 15/118 |
| 5,465,452 | 11/1995 | Girardot et al. | 15/210.1 |
| 5,516,099 | 5/1996 | Strong | 473/614 |
| 5,533,227 | 7/1996 | Ito et al. | 15/167.1 |
| 5,555,591 | 9/1996 | Chang | 15/210.1 |
| 5,560,071 | 10/1996 | Chang | 15/222 |
| 5,678,273 | 10/1997 | Porcelli | 15/104.94 |
| 5,678,275 | 10/1997 | Derfner | 15/167.1 |
| 5,727,277 | 3/1998 | Chien | 15/209.1 |
| 5,727,278 | 3/1998 | Per-Lee | 15/229.11 |

FOREIGN PATENT DOCUMENTS

| | | | |
|---|---|---|---|
| 561498 | 10/1923 | France | 15/207.2 |
| 38008 | 4/1912 | Sweden | 15/226 |
| 10198 | of 1912 | United Kingdom . | |
| 95/00116 | 1/1995 | WIPO . | |

*Primary Examiner*—Mark Spisch
*Assistant Examiner*—Theresa T. Snider
*Attorney, Agent, or Firm*—Gerald J. McGowan, Jr.

[57] ABSTRACT

A washing system using a washing implement including looped filaments, together with a surfactant-based cleanser.

18 Claims, 5 Drawing Sheets

FIG. 3
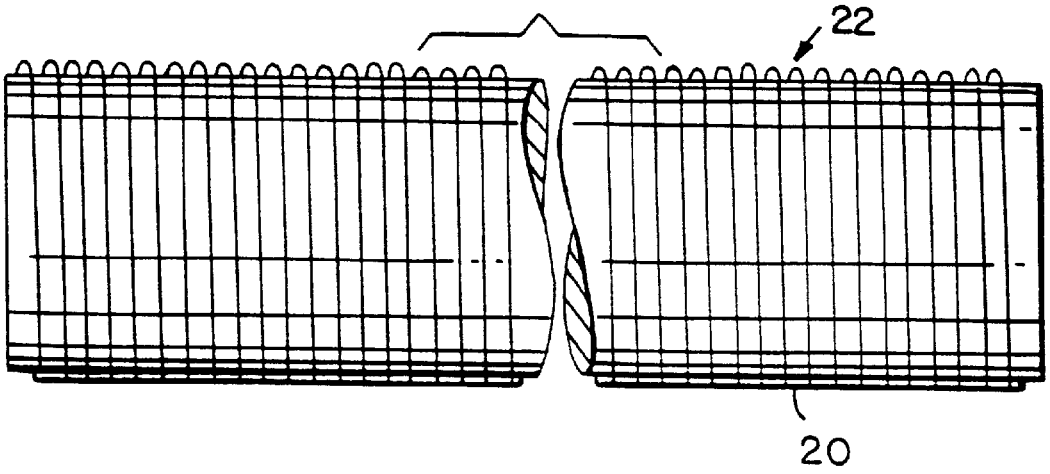
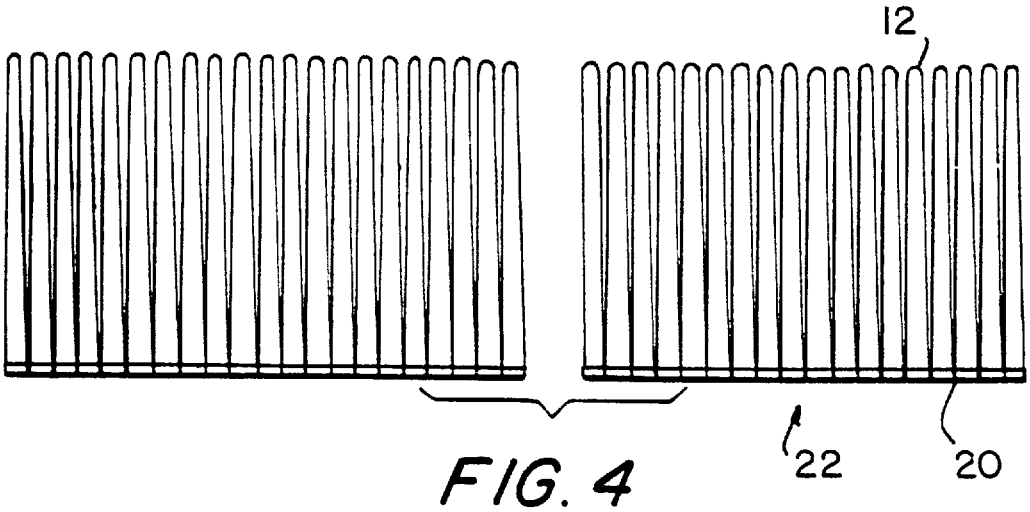
FIG. 4

FIG. 7
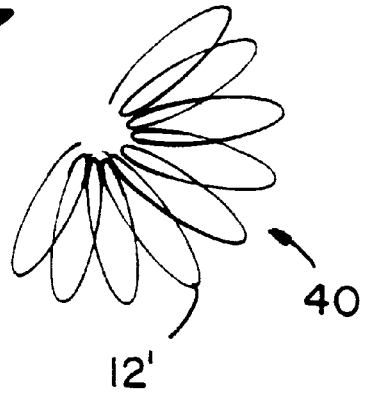
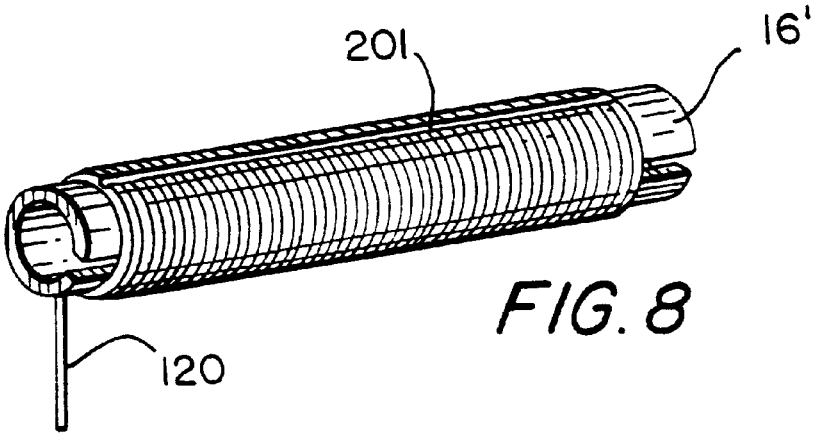
FIG. 8
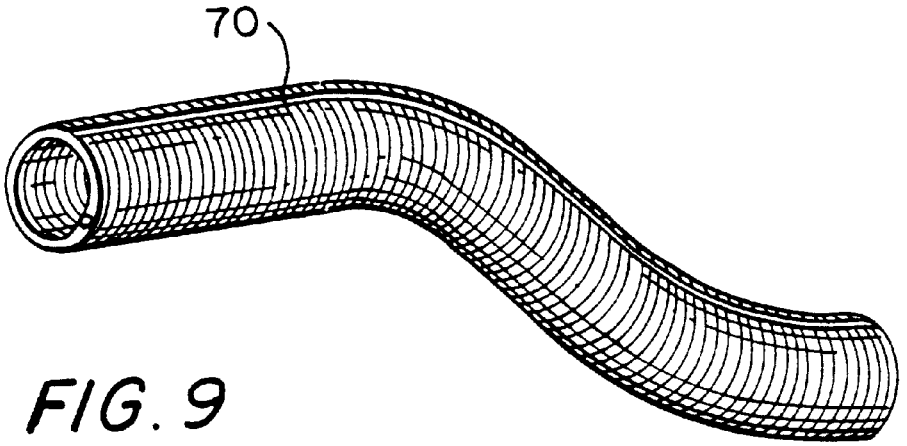
FIG. 9

BATHING IMPLEMENT CONSTRUCTED OF LOOPED FILAMENTS

BACKGROUND OF THE INVENTION

Liquid personal washing cleansers have recently been gaining in popularity. A difficulty with their use is that there is lacking a solid, tangible washing implement, such as a soap bar, which the consumer is accustomed to use, e.g. in the shower. Also, it would be beneficial to improve the lathering of the liquid cleansers.

Campagnoli, U.S. Pat. No. 5,144,744 discloses a diamond-mesh polyethylene sponge obtained by stretching a plurality of tubes, binding all of the tubes together near a common center of all of the stretched tubes and releasing all the tubes from their stretched condition whereby the tubes through their resiliency rebound into a rounded sponge shape. As illustrated in the Campagnoli patent, the diamond mesh sponge has a "frilly" appearance which does not appeal equally to male and female users.

Sanford, U.S. Pat. No. 4,462,135 discloses a cleaning and abrasive scrubber which is made in part of numerous layers of netting mesh polymeric material. An abrasive solid is used which is a coiled product such as may be obtained from shavings of metals such as steel, brass and copper. The solid must be hard enough to give the necessary abrasive action, but flexible enough to be coiled around the center core. The solids may be prepared from a variety of materials which meet this requirement such as metal, wood, plastic and the like. The Sanford scrubbers are said to be useful for a great many applications, including cleaning and scrubbing the various parts of the body.

WO 95/00116 discloses a system for cleaning the skin which comprises a diamond mesh sponge and a liquid cleansing and moisturizing composition, which system is said to have excellent lather.

Lemelson, U.S. Pat. No. 3,226,751 discloses a combination sponge and scouring device. The implement includes a soft and flexible cellular base section made of any suitable, flexible expanded plastic and scouring elements.

Lemelson, U.S. Pat. No. 3,414,928 discloses a combination sponge and scour. The device includes a cellular expanded plastic base, an unexpanded material secured to a portion of the surface of the base, and a plurality of scouring elements secured to and supported by the unexpanded plastic material. In one method of manufacture, plastic scouring material may be disposed against the cellular member, while molten, and compressed, whereby at least a portion of the cellular member is embedded in the molten surface layer to become encapsulated when it solidifies.

Wagner, U.S. Pat. No. 4,027,352 discloses a scouring pad made with a strip of expanded plastic material having one end folded over a stiff plastic contoured member to provide a controlled contour to the pad.

Landsberg, U.S. Pat. No. 3,634,901 discloses a combined cleaning and abrading or scouring utensil. It comprises an absorbent pad having a plurality of crinkled or wavy monofilament plastic elements of angular sharp edged cross section. The scouring elements are functionally secured to the pad as by one or more curved needles.

Barber, U.S. Pat. No. 4,980,943 discloses a cleaning glove including a glove base having a side to which there is attached a primary layer of a tufted blended yarn and one or more fibrous bristle portions or strips.

Girardot et al., U.S. Pat. No. 5,465,452 discloses a first extended tubular scrim having a diamond mesh pattern used to construct a personal cleaning implement. The first scrim is placed in an oven to heat set the scrim in a pleated and expanded condition. A second piece of tubular scrim is placed inside the pleated and expanded first tubular scrim and the first end of the second piece is inverted over the outside of the pleats and connected to the other end to envelope the pleated and expanded scrim tubing. The implement has a high open area without a dense center core which would inhibit rinsing and drying. If desired, the second piece of scrim may be made of a different scrim material then the first scrim in order to provide the implement with a softer feeling, skin contacting implement surface.

Rasmason, U.S. Pat. No. 4,154,542 is directed to a shower mitt which includes a mesh sheet of nylon net to provide a soap-retaining pocket.

Wideman, U.S. Pat. No. 4,606,964 is directed to a bulked web composite which comprises a differentially tensioned reticulated web of elastic material banded to at least one gatherable web.

Abraham, U.S. Pat. No. 2,581,779 discloses a scouring pad said to have a greater ease of manipulation.

Winston, U.S. Pat. No. 3,103,031 discloses a composite scouring pad made by folding plastic fibers with metallic filaments into an open batt.

Caul et al., U.S. Pat. No. 3,254,357 is directed to a cleaning pad which is a felt of randomly arranged animal hair, the pad having a stiff scrubbing side in which the individual hair fibers are coated with a thermoset resin and a flexible side free from said resin. An object is to have a scrubbing side and a polishing side.

Stillinger, U.S. Pat. No. 4,756,529 is directed to a substantially spherical amusement device formed from a large plurality of floppy elastomeric filaments that radiate in a dense, bushy manner from a central core region. The filaments are said to be sufficiently floppy to collapse on impact. The features of the device are said to promote sure and quick capture of the device during the act of catching. In FIG. 7, the filaments form loops.

Oddz On Products, Inc. of Campbell, California sells a product called "Krinks" which is similar to the device of the Stillinger '529 patent, except that the filaments are curled.

Stillinger, U.S. Pat. No. DES 317,489 is directed to the ornamental design for a throwing toy. The throwing toy appears to be substantially spherical and to be composed of filaments radiating from a central core. It appears to be somewhat similar to that disclosed in Stillinger, U.S. Pat. No. 4,756,529, mentioned above.

Paranto, U.S. Pat. No. 4,927,141 is directed to a novelty ball having a multiplicity of extending flexible whisker like protrusions.

Arioli, U.S. Pat. No. 2,817,865 discloses a sponge covered strand washcloth with soap pocket. The strands cross and are interwoven.

Kingman, U.S. Pat. No. 1,991,559 is directed to a detergent abrasive scouring pad. The pad comprises an outer enveloping integument of more or less open mesh metallic abrasive fabric and an inner integument of material normally offering strong resistance to penetration therethrough of liquid and a central mass of soapy detergent material enclosed by the inner integument. The mesh metallic fabric is preferably a tubular knitted fabric produced from a flat or ribbon like metallic strand or wire.

Campbell, U.S. Pat. No. 4,190,550 is directed to a fibrous soap filled pad which when used as a bathing aid imparts a cleansing and mildly stimulating rubbing action to human skin. A seamless envelope of crimped resilient stretchy synthetic fibers surrounds a core of solid soap or other suitable surfactant material and is held in integral form solely by the interentanglement of the fibers. The fibrous soap filled pad is useful in imparting a cleansing and mildly stimulating rubbing action to human skin during bathing. In an alternative form, a ball of loose fibers can be formed into an integral spherical shape by needling after which melted soap can be injected or impregnated into its interior to form a solid core.

Kingman, U.S. Pat. No. 2,026,638 is directed to a hand held implement for cleaning, scouring and polishing kitchen utensils, metal and other surfaces which require the application of abrasive action to effect best results. The scouring implement includes a foraminous resilient body such as a mass of sponge rubber having imposed upon the major portion of its external surface a metal mesh. The foraminous body may be saturated with a suitable cleansing fluid such as, e.g. soap and water. The mesh is preferably of a knitted formation although other cross sectional shapes of wire or strand may be employed. As the implement is rubbed back and forth over the surface, the edges of the metallic loops of the mesh will exert a strong scraping effect, to loosen and scrape away encrusted and cakes dirt and soil.

Pusch, U.S. Pat. No. 2,654,191 is directed to a pot cleaner comprising a deep pile fabric, preferably composed of terry cloth or Turkish toweling and having uncut pile loops forming the nap thereof. It is said that the terry cloth component base fibers will remain soft, pliable and highly absorptive of water, more especially of soapy water and a detergent solution. The cleaning cloth is designed for heavy duty work in the cleaning of pots, pans and the like.

Stoker, U.S. Pat. No. 3,146,479 is directed to an ornamental device for scouring, washing and drying surfaces, particularly bathroom fixtures such as wash bowls and the like. A long folded strip of nylon net is wound upon itself to form a loose roll which simulates the petals of a flower. A base made of spongy water absorbent material such as sponge rubber supports the flower simulating portion. Nylon net is said to have the property of springiness and is said to be gently abrasive to serve as a brush for cleaning purposes. It is said to resume its original form after having been compressed and deformed in use. The net is said to lack water absorptive properties. The function of absorbing water is achieved by the spongy base. The folded edge of the nylon net is said to function like a brush as it is passed back and forth over the surface being cleaned. Instead of nylon net, other materials having the properties of springiness and non-absorptiveness may be used.

Heyer et al., U.S. Pat. No. 4,199,835 is directed to a scouring pad in the shape of a ball comprising a plurality of radial slit regular shaped planar segments of conformable low density non-woven abrasive product fastened together under compression at the center. The use of lofty, fibrous, non-woven abrasive products for scouring pots and pans which are typically open mats formed from randomly disposed crimped staple fibers which are bonded at points where they intersect and contact each other with a binder is described as known. The segments may be interleaved with layers of foam material to provide for specific properties.

Schubert, U.S. Pat. No. 4,969,225 is directed to improved scrub brushes specifically made to contain a bar of soap for use for bathing, cleansing and the like. The invention utilizes an elastic, synthetic, fibrous batt or chemical foam. The batt or open-cell chemical foam is formed into a desirable shape to include an internal cavity or tunnel to contain a bar of soap or other solid cleansing substance. The batt may be made of a woven synthetic material or surrounded by a netting of woven synthetic material. The brush could be made with grooves or cuts in the face for improved scrubbing action.

Pritschau, U.S. Pat. No. 574,449 is directed to a sponge treated with abrasive powder.

Rath, U.S. Pat. No. 4,214,341 is directed to a sponge for medicinal purposes. The sponge is made of fabric cut, preferably gauze fabric cut which is folded to a pouch with an edge framed by a rubber ring and folded inside out.

Hanazono, U.S. Pat. No. 4,343,061 is directed to a bathroom implement and specifically to a body washing implement which is said to be useful when used in combination with a towel or washcloth for washing an area of the body of a bath user that is difficult of access by his hands or by the towel or washcloth. The implement comprises a sponge member having at least one closed loop portion and a covering web wrapping the sponge member therein. The covering web having the sponge wrapped therein is preferably comprised of a woven, non-woven, knitted or braided fabric which is relatively coarsely meshed. The washing implement of the '061 patent may be used as a bath sponge independently of any other washing implement but is said more advantageously to be used in combination with an elongated strip of cloth such as a washing towel.

SUMMARY OF THE INVENTION

A new washing system has been discovered which includes a washing implement which may have a less "frilly" appearance than many of the sponges or "poufs" presently on the market. Thus, the invention provides the consumer with an object to generate lather, particularly in conjunction with liquid washing products, which may be expected to have a more uniform appeal to men, women and children.

The washing implement of the invention comprises a plurality of floppy filaments which are fixed at one end and free at a second end. Preferably the filaments are polymeric. In general the cross-sectional dimensions of each filament will be small in relation to the length of the filament. The filaments may be elastomeric or non-elastomeric. Preferably use of a large plurality of tiny filaments offer substantial gripping surface area. Indeed, the user of the washing implement will be enabled to thread his or her hands through the filaments. While the use of filaments that have a very small diameter as compared to filament length is envisioned primarily, the use of larger filaments may also be advantageous.

The invention is also directed to a method of manufacturing the implement to preferred forms of the implement. A preferred method of manufacturing the implement used in the invention is to wind a filament around the length of a mandrel and to bond the wound filament along an axis extending longitudinally along the mandrel. The axis may be anywhere along the circumference of the mandrel and is preferably generally parallel to the longitudinal axis of the mandrel. Alternatively, the loops may be bound along an axis which is disposed at an angle to the longitudinal axis of the mandrel.

The loops may be bound along the binding axis by any of numerous means, e.g., imposing a heated bar along the binding axis to melt the material of which the loops are made, whereby to seal them together. Each loop should be sealed together to one or two adjacent loops at one of its ends and free from attachment to any other loops at its other end. The result is a plurality of loops "strung together," each of the loops being attached to the "string" at only one end. Effectively then, the string of loops may be formed by creating a spiral and bonding the loops of the spiral together along a longitudinally extending axis.

The size and diameter of the mandrel used in manufacturing the string of loops can be expected to influence the feel and texture of the washing implement. Mandrel dimensions may also be used to influence exfoliation properties of the implement.

In a particularly advantageous embodiment, the string of loops is itself wound around a ring made of plastic or other material, the ring being of a substantially larger diameter than the loops. This results in a hand held implement which is itself useful to generate lather, particularly in conjunction with a shower gel product, but which also can be folded or twisted into various forms. These forms may be either secured by a cord or may be held temporarily while the user is employing the implement. Thus, this preferred form provides substantial flexibility.

The looped implement of the invention has been found to generate excellent lather when used in conjunction with shower gels. It has been reported in WO 95/00116 and elsewhere that skin conditioning ingredients used in shower gels tend to decrease foaming. Therefore, it may be particularly advantageous to use the excellent lather generation of the present implement in systems according to the instant invention including particularly, cleansing and conditioning or moisturizing compositions.

Another form of the washing implement according to the invention is the looped amusement device illustrated in Stillinger, U.S. Pat. No. 4,756,529, FIG. 7, although it may be desirable to replace his rubber, elastomeric filaments with non-rubber and/or non-elastomeric filaments. Stillinger, U.S. Pat. No. 4,756,529 is hereby incorporated by reference herein. When the washing implement takes the form illustrated for the amusement device of Stillinger, it is substantially spherical with a plurality of looped floppy filaments radiating in a dense, bushy manner from a central core region. Generally, in this embodiment, the filaments will radiate outwardly in plural offset planes. In this embodiment, the washing implement is perceived as being "toylike," whereby it will appeal to men, women and children. Indeed, it can be used to promote washing as "fun."

In the implement of the invention, the plurality of filaments is used to form the skin contacting surfaces.

The washing system of the invention comprises the washing implement and a surfactant-based cleanser. The surfactant-based cleanser may be a conventional soap bar, a mild surfactant bar such as those made under the Dove® and Caress® brand names, or, more preferably, the washing implement is used in conjunction with a liquid or semi-liquid surfactant-based cleanser. It is the use with the liquid cleansers wherein the washing implement finds its greatest utility, since there is a need with liquid cleansers for the consumers to have an implement to grasp and with which to generate lather. The liquid cleanser may comprise conventional surfactants such as soaps or synthetic surfactants such as mild surfactants found in products such as Dove® and Caress® mild washing bars.

As indicated above, in a particularly preferred embodiment, the liquid cleanser of the washing system includes a moisturizing ingredient in addition to a surfactant.

The invention is also directed to a method of using a looped implement as a washing implement in personal washing.

For a more complete understanding of the above and other features and advantages of the invention, reference should be made to the following detailed description of the preferred embodiments and to the accompanying drawings.

BRIEF DESCRIPTION OF THE DRAWINGS

FIG. 3 shows the mandrel and filament of FIG. 2 after the sealing bar has been imposed along a longitudinal axis of the mandrel and removed.

FIG. 4 shows the string of looped filament after it has been slid off of the mandrel in FIG. 3.

FIG. 7 is a partial perspective view of an alternate embodiment of the invention.

FIG. 8 is a perspective view of a preferred mandrel with filament wound thereon.

FIG. 9 is a perspective view of a string of loops 70 according to the invention.

DETAILED DESCRIPTION OF THE INVENTION

Figure 1:
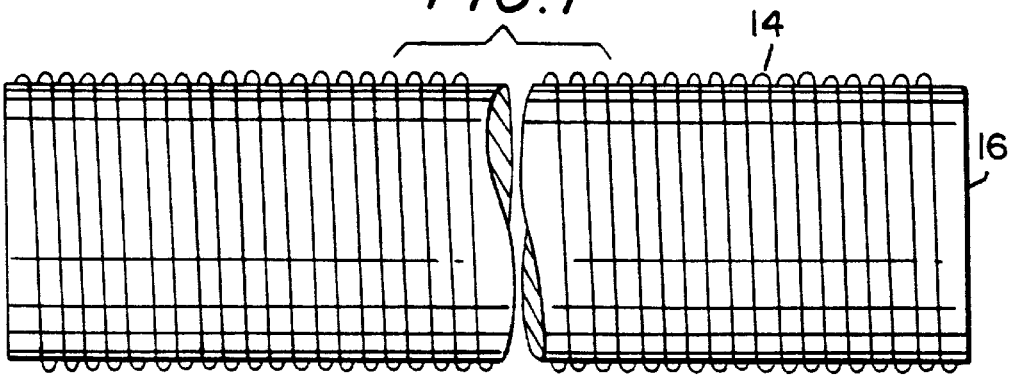
FIG. 1 is a side view of a mandrel having filaments wound therearound with parts broken away.
Figure 2:
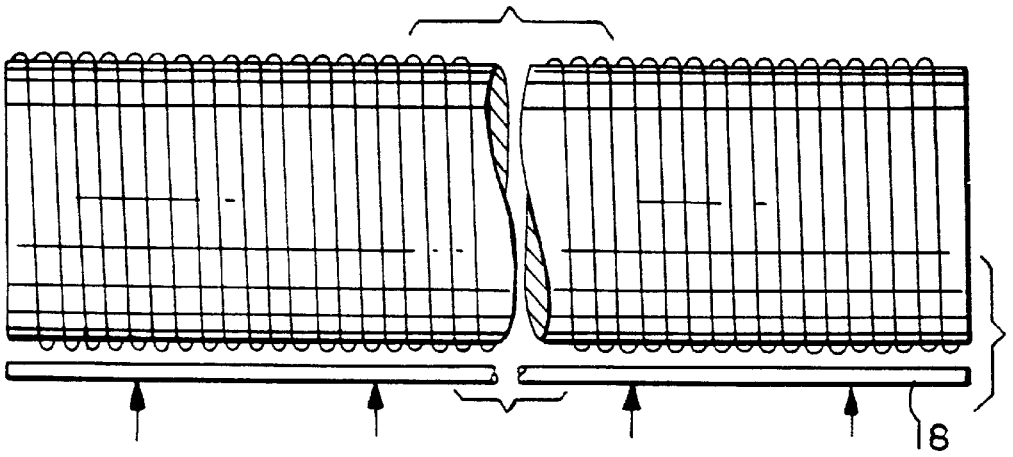
FIG. 2 shows the mandrel and filament of FIG. 1 with a sealing bar disposed adjacent one longitudinal axis of the mandrel.

The washing implement 10 (FIG. 5) is formed by joining a plurality of loops 12 which preferably are made of a filamentous material. In accordance with a preferred method of manufacture, a filament such as polyethylene filament 14 is wound around a mandrel 16 to form a spiral (FIG. 1). The spacing of the filaments along the mandrel can be varied in accordance with the desired spacing of the loops relative to each other. As seen in FIG. 2, a sealing bar 18 extends along the longitudinal axis of the mandrel proximate any point of the circumference of the mandrel.

When it is desired to form the loops, the sealing bar, which has been heated to a temperature sufficient to melt the material of which the loops are made, is brought into contact with the loops along the longitudinal axis of the mandrel. As a result, a band 20 of melted polyethylene is formed which joins the adjacent filaments of the spiral to each other at one end of each loop of the spiral (FIG. 3). Upon cooling of band 20, string 22 of loops 12 can be removed from the mandrel by sliding longitudinally. The result, as seen in FIG. 4, is a unitary string of loops 12, each loop being attached at one end to band 22 and being free at the other end.

Other methods and implements may be used to fuse the loops together to form the spine of the loop string. These include, in addition to the induction mold formed by the heat sealing bar, laser and ultrasound treatments.

Figure 10:
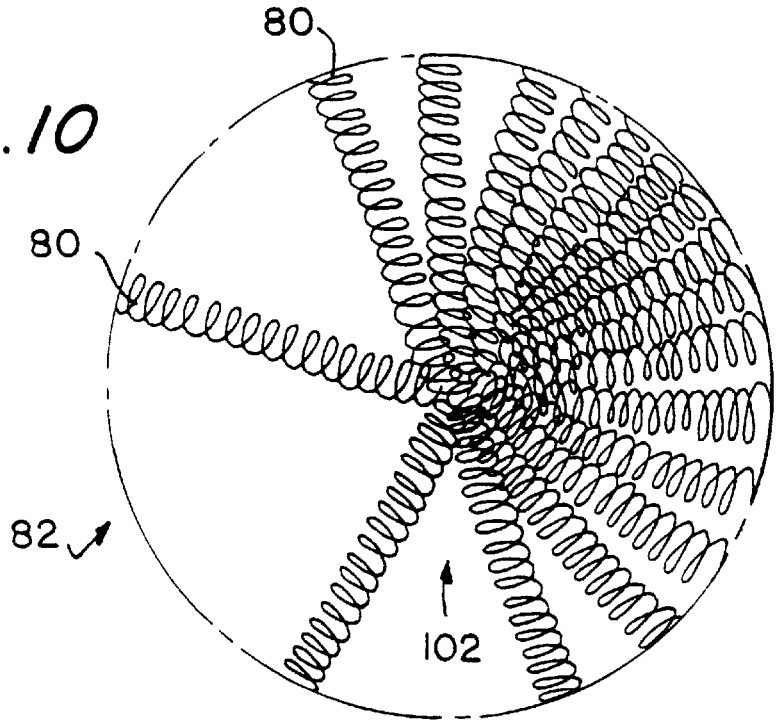
FIG. 10 is a perspective view of a further embodiment.
Figure 11:
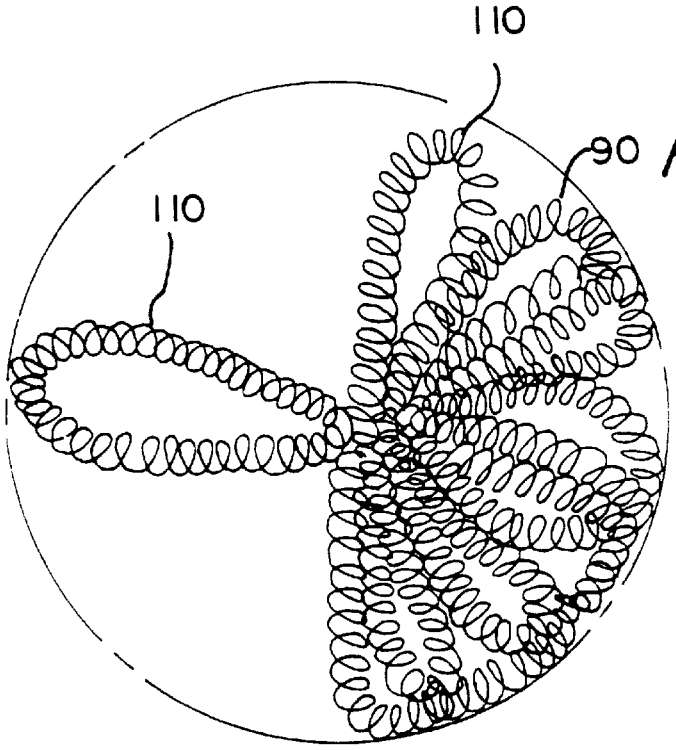
FIG. 11 is a perspective view of a still further embodiment of the bathing implement.

Alternate forms of the implement of the invention are seen in FIGS. 10 and 11. In FIG. 10, the looped filaments 80 are bound together at a central core 102 and extend outwardly to form the core of implement 82. In FIG. 11, the loop strings themselves are wound to form macro loops 110 which are bound in a central core.

In a preferred embodiment, the mandrel is collapsible after formation and fusing of the loops to facilitate removal of the loop string from the mandrel. Collapsible mandrel 16' is shown in FIG. 8.

The mandrel may be made of a variety of cross sections. In general, the "loops" will assume the cross sectional shape of the mandrel. Examples of possible shapes include generally circular (including, e.g., oval) clover leaf, hexagonal and star shapes.

Figure 5:
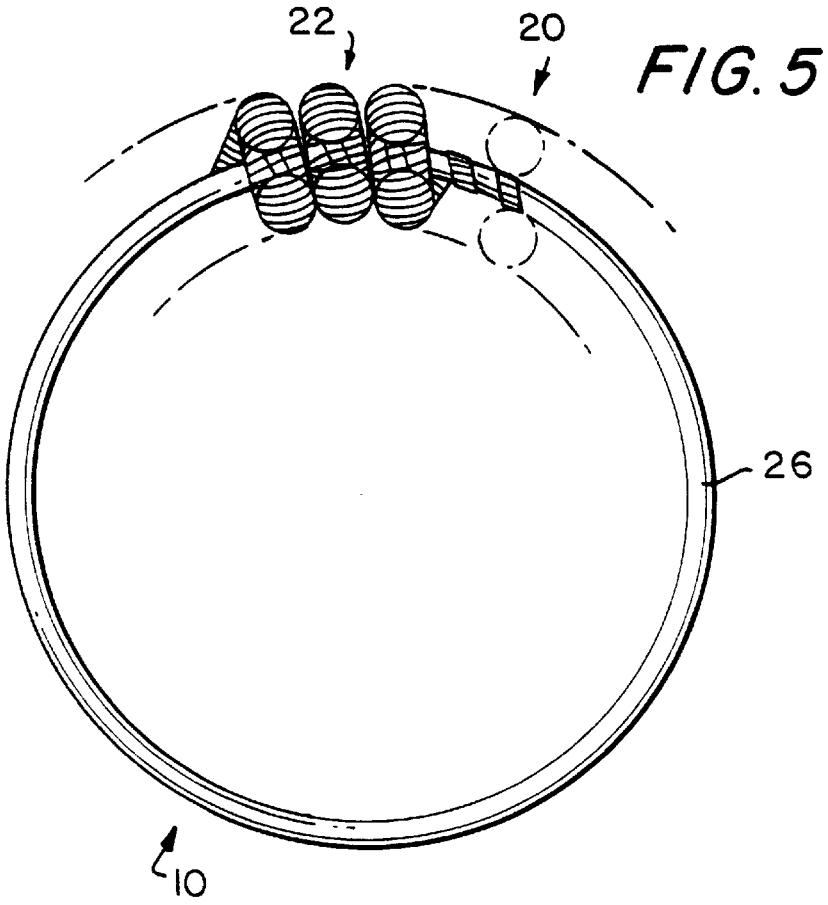
FIG. 5 is a top plan view of a preferred implement according to the invention, with the lather forming loops shown in a fragmentary view.
Figure 6:
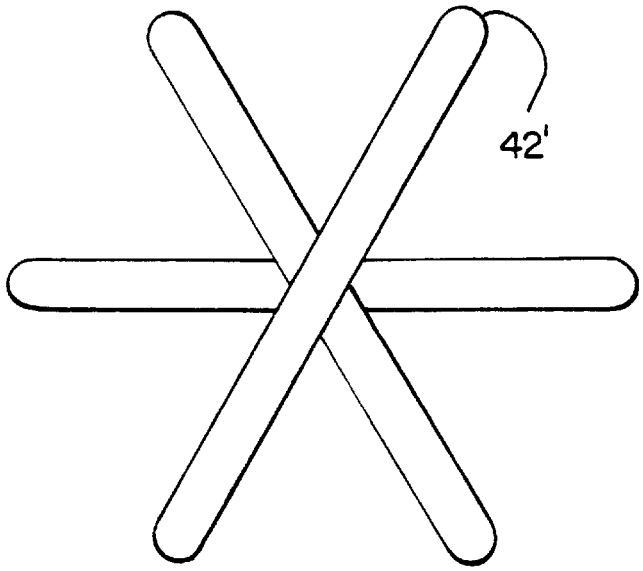
FIG. 6 shows loops which may be used to form an alternate embodiment of the washing implement.

In FIG. 5, which illustrates a preferred embodiment, it will be appreciated that most of the loops 12 have been removed from the illustration to permit clearer viewing of underlying parts. In the particularly preferred FIG. 5 embodiment, a ring 26, preferably of a polymeric material, is used as the base of the implement. String 22 is wound around substantially 360° of the ring 26 (although, again, only 10° or so of ring 26 is illustrated as including string 22). As in FIG. 4, each loop 12 of string 22 is connected to band 20 at one of its ends and is free at the other end. One aspect of band 20 is shown crossing ring 26 with the loops shown in phantom so that the band can clearly be seen. Since ring 26 is preferably made of flexible polymeric material such as polyethylene, implement 10 can be twisted if desired. Thus, it can be used in essentially a non-twisted, "bracelet" form as a washing implement or it can be twisted into another form and either secured in that shape or left unsecured according to the desires of the user or retailer.

The preferred loops are circular as in FIGS. 4 and 5, in contrast with the non-circular nylon netting shown in FIG. 3 of Stoker, U.S. Pat. No. 3,146,479. The loops of the invention are preferably not attached by means of a pile fabric. Rather, as seen in FIG. 4, the loops are preferably attached by heat sealing along a line along one side. The filament from which the loops are prepared is preferably a monofilament, preferably made of a polymeric material. Suitable materials include those used for lines used in fishing rods. Such materials are available, e.g. as TPU filaments from the monofilament division of the Shakespeare Company of Columbia, S.C. For example, polyurethane monofilament having a diameter of 0.020 inches and the following average properties might be used:

| | | |
|---|---|---|
| tensile | @ 200% elongation | 5.7 lbs. |
| tensile | @ break | 8.3 lbs. |
| elongation | @ break | 247.0% |
| tensile | @ 50% elongation | 0.5 lbs. |
| tensile | @ 100% elongation | 1.7 lbs. |

Suitable monofilaments may include those having a diameter ranging from 0.008 to 0.026 inches, a denier ranging from 300–1600, tensile strength from 12,000 to 26,000 psi, elongation at break from 120–280%, tensile @ 50% elongation of 26–140 gms., and tensile @ 100% elongation of 70–520 gms.

The filaments herein are preferably individual rod- or ribbon-like structures and are used to form a loop free at one end. Also, the filaments are not made from a netting material. In general, the diameter for the filaments will range from 0.25 to 3 mm, preferably form 0.75 to 1.5 mm. By "diameter" in this context is meant the maximum thickness in the case of a ribbon-like structure or the true diameter in the case of a rod-like structure. In general, the length of the filaments will be from 0.5 inches to 8 inches, especially from 1.5 to 3 inches. To improve lathering or cleaning of the skin, if desired, the filaments may be micro textured, e.g. to provide a non-smooth surface along their diameters, thickness or depths.

In an alternate embodiment, the implement comprises looped filaments secured in a central core region so that they radiate outwardly in a fairly uniform dense and bushy fashion in multiple angularly offset planes to form a substantially spherical configuration. Preferably the diameter of the spherical implement 40 (FIG. 7) ranges from about two inches to about six inches, especially from about three to about five inches.

The loops 12' of which the washing implement 40 are fabricated are preferably made of a relatively soft, floppy material, preferably one which feels quite soft to the skin. In contrast with prior toy balls of similar structure, the filaments of the implement of the present invention will generally be made of a non-rubber material. As disclosed for the toy of Stillinger, U.S. Pat. No. 4,756,529, the washing implement may be made by stretching loops 42' of the filament material, disposing these loops at angles relative to each other, cinching the loops centrally and drawing them tightly together. The filaments of FIG. 7 are flexible but looped.

The floppy filament of the alternate embodiment is preferably made of a polymer such as polyethylene and advantageously is somewhat resilient. The material forming the loops in all of the embodiments may also be made of addition polymers of olefin monomers other than ethylene or of polyamides of polycarboxylic acids and polyamines. An alternative material is nylon. The materials from which the implements are formed are preferably strong, flexible polymeric materials. Floppy filaments are soft and flexible, tending to move irregularly to and fro or up and down. Due to their loose and flexible character the floppy filaments of the washing implement tend to kiss against the skin of the user. The filaments may be microtextured as by adding dimples, bumbs or other pattern to the surface of the filaments. It can be expected that the texturing of the filaments will improve lathering skin cleaning and skin feel.

It is preferred that the cleaning implement not include a rigid handle, e.g. of plastic. The implement may include an optional cord for e.g., hanging in the shower. The cinching device may be a cord made of a natural material such as rope or a synthetic polymer such as nylon, polyethylene or polypropylene.

As seen in FIG. 8, the mandrel 60 may be collapsible. Ultrasonic or induction weld fuse line 201 can be seen extending down the spine. Polymer monofilament 120 may have any of numerous cross sections, such as circular, clover leaf, hexagonal, star-shaped, etc. FIG. 9 illustrates a string 70 of loops, which is curved and fused into a tube. It may then be formed into a variety of shapes to form the implement for washing. In FIG. 10, the strings 80 of loops emanate from the center of implement 82, extending along axis through the center of the implement. The coiled filaments disperse from the bound core 102. In FIG. 11, the strings of loops 90 are themselves looped and tied in the center.

The implement of the invention is used in conjunction with a cleaning formulation which includes a surfactant. While the cleaning formulation is preferably liquid or semi-liquid, e.g. not a soap bar, soap bars may also be used. The system of the invention may, for instance, be sold in the form of a pack or kit. In its preferred form, the system includes a cleaning formulation which is suitable for application to the human skin. Even more preferably, the cleaning formulation includes a skin conditioning and moisturizing ingredient.

Preferably the surfactant is a mild surfactant. It is also preferred that the surfactant is a foaming surfactant. The surfactant should be a relatively mild surfactant suitable for washing human skin and may be, e.g., an anionic, amphoteric, cationic or nonionic surfactant. Among the mild surfactants which may be used are cocamidopropyl betaine, sodium cocoylisethionate and mild soap. Among other surfactants which may be used are soap and sodium laureth sulfate.

Moisturizers may include oils, cationic and certain nonionic and anionic surfactants. Among the moisturizers which may be used are polyols such as glycerin and glycerine, propylene glycol polyethylene glycol, mono, di and triesters, lanolin, and its derivatives, mineral oil, petrolatum, vegetable oils, silicone gum, silicone oil and quaternary compounds. A preferred moisturizer is the dimethicone emulsion sold as Dow Q2-1656, which is a 50% silicone emulsion. Other moisturizers include adducts of vegetable oil with acrylic acid, fumaric acid or maleic anhydride, epidermal and sebaceous hydrocarbons such as cholesterol, and squalene and derivatives such as esters and skin moisturizing cationic polymers such as cationic polysaccharides. Other ingredients such as thickeners such as ammonium sulfate and opacifiers such as mica/titanium dioxide may be used. Water, of course, may also be included.

The cleanser may be single phased, eg., it may contain only an aqueous phase; or it may include more than one phase, eg., an oil phase, (eg. Moisturizers) and an aqueous phase. It may be an emulsion or a microemulsion.

Preferably surfactants are employed such that the surfactant, if used alone, or the surfactant mixture is milder than would be soap itself as measured by the zein solubilization test (soap yields 80% zein solubilized). Preferably the zein solubilization is in the range of 10–60%.

Among suitable anionic co-actives are the alkyl ether sulfates, acyl isethionates, alkyl ether sulfonates, sarcosinates, sulfosuccinates, taurates and combinations thereof. Among suitable amphoteric co-actives may be included alkylbetaines, amidopropyl betaines, amidopropyl sultaines and combinations thereof.

Alkyl ether sulfates used in the present invention may be of the general formula $R—(OCH_2CH_2)_nOSO_3—M^+$ wherein R ranges from $C_8$–$C_{20}$ alkyl, preferably $C_{12}$—$C_{15}$ alkyl, n is an integer from 1 to 40, preferably from 2 to 9, optimally about 3, and $M^+$ is a sodium, potassium, ammonium or triethanolammonium cation.

Typical co-actives of this variety are listed below:

Sodium Laureth Sulfate (liquid or paste)
TEA Laureth Sulfate (paste)
Sodium Laureth-12 Sulfate (liquid)
Sodium Trideceth Sulfate (paste)
Ammonium Laureth Sulfate (liquid)

Alkyl ether sulfonates may also be employed in the present invention. Illustrative of this category is a commercial product known as Avenel S-150 commonly referred to as a sodium $C_{12}$—$C_{15}$ Pareth-15 sulfonate.

Another co-active type suitable for use in the present invention is that of the sulfosuccinates. This category is best represented by the monoalkyl sulfosuccinates having the formula $RO_2CCH_2CH(SO_3—Na^+)COO—M^+$; and amido-MEA sulfosuccinates of the formula: $RCONHCH_2CH_2O_2CCH_2CH(SO_3—M^+)COO—M^+$; wherein R ranges from $C_8$–$C_{20}$ alkyl, preferably $C_{12}$–$C_{15}$ alkyl and $M^+$ is a sodium, potassium, ammonium or triethanolammonium cation. Typical commercial products representative of these co-actives are those listed below:

Disodium Lauryl Sulfosuccinate (solid)
Disodium Cocoamido MEA Sulfosuccinate (liquid)
Disodium Myristamido MEA Sulfosuccinate (paste)
Disodium Oleamido MEA (liquid)
Disodium Ricionoleamido MEA Sulfosuccinate (solid)

Sarcosinates may also be useful in the present invention as a co-active. This category is indicated by the general formula $RCON(CH_3)CH_2CO_2—M^+$, wherein R ranges from $C_8$–$C_{20}$ alkyl, preferably $C_{12}$–$C_{15}$ alkyl and $M^+$ is a sodium, potassium ammonium or triethanolammonium cation. Typical commercial products representative of these co-actives are those listed in the Table below:

Sodium Lauroyl Sarcosinate (Solid)
TEA Cocoyl/Sarcosinate (Liquid)

Taurates may also be employed in the present invention as co-actives. These materials are generally identified by the formula $RCONR'CH_2CH_2SO_3—M^+$, wherein R ranges from $C_8$–$C_{20}$ alkyl, preferably $C_{12}$–$C_{15}$ alkyl, R' ranges from $C_1$–$C_4$ alkyl, and $M^+$ is a sodium, potassium, ammonium or triethanolammonium cation. A typical co-active is listed below:

Sodium Methyl Cocoyl Taurate (paste)

Within the category of amphoterics there are three general categories most suitable for the present invention. These include alkylbetaines of the formula $RN^+(CH_3)_2CH_2CO_2—M^+$, amidopropyl betaines of the formula $RCONHCH_2CH_2CH_2N^+(CH_3)_2CH_2CO_2—M^+$, and amidopropyl sultaines of the formula $RCONHCH_2CH_2N^+(CH_3)_2CH_2SO_3—M^+$ wherein R ranges from $C_8$–$C_{20}$ alkyl, preferably $C_{12}$–$C_{15}$ alkyl, and $M^+$ is a sodium, potassium, ammonium or triethanolammonium cation. Typical of these co-actives are:

Cocamidopropyl Betaine (liquid)
Cocamidopropyl Hydroxysultaine (Liquid)
Coco-Betaine (Liquid)
Myristamidopropyl Betaine (Liquid)
Oleyl Betaine (Paste)

Within the broad category of liquid actives, the mos t effective are the alkyl sulfates, alkyl ether sulfates, alkyl ether sulfonates, sulfosuccinates, and amidopropyl betaines.

Another preferred surfactant is an acyl isethionate having the formula

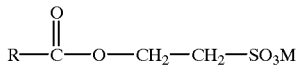

in which R denotes a linear or branched alkyl group and M denotes an alkali metal or alkaline earth metal or an amine.

Another surfactant which may be used are the monoalkyl or dialkylphosphate surfactants.

Another mild surfactant which may be used, preferably used as primary surfactant in combination with other surfactants noted above, is sodium coco glyceryl ether sulfonate. While desirable to use because of its mildness properties, this coco AGS alone does not provide optimum lather creaminess. A sodium 90/10 coconut/tallow alkyl AGS distribution is preferred for creaminess. Salts other than the sodium salt such as TEA-, ammonium, and K-AGS and chain length distributions other than 90/10 coconut/tallow are usable at moderate levels. Also, some soap may be added to improve lather volume and speed of lathering. Certain secondary co-surfactants used in combination with AGS can also provide a creamier and more stable lather. These secondary surfactants should also be intrinsically mild. One secondary surfactant that has been found to be especially desirable is sodium lauroyl sarcosinate (trade name Hamposyl L, made by Hampshire Chemical).

The amphoteric betaines and sultaines noted above can be used as the sole surfactant, but are more preferred as a co-surfactant. Nonionics generally should not be used as the sole surfactant in this product if high foaming is desirable; however, they can be incorporated as a co-surfactant.

Nonionic and cationic surfactants which may be used include any one of those described in U.S. Pat. No. 3,761,418 to Parran, Jr., hereby incorporated by reference into the present application. Also included are the aldobionamides as taught in U.S. Pat. No. 5,389,279 to Au et al; and the polyhydroxy fatty acid amides as taught in U.S. Pat. No. 5,312,934 to Letton, both of which are incorporated by reference into the present application.

Soaps can be also be used. Preferably, soaps are used at levels of from about 1 to 10 wt % and at higher levels preferably where the surfactant mixture is milder than soap. The soaps may be added neat or made in situ via adding a base, e.g., NaOH; to convert free fatty acids. Preferably, soaps are only be used as cosurfactants to the extent that the surfactant system is milder than soap alone.

A preferred surfactant active system is one such that acyl isethionate comprises 1 to 15% by weight of the total composition, an anionic other than acyl isethionate (e.g., ammonium lauryl ether sulfate) comprises 1 to 15% by weight of the total composition and amphoteric comprises 0.5 to 15% by weight of the total composition.

Another preferred active system is one comprising 1 to 20% alkyl ether sulfate. Preferred surfactant active systems may also contain 1 to 10% alkali metal lauryl sulfate or $C_{14}$–$C_{16}$ olefin sulfonate instead of acyl isethionate.

Preferably the surfactant or surfactant system is used in a liquid cleansing formulation having, for example, from about 10% to about 99% water.

The compositions of the invention preferably comprise anionic surfactants which are not nitrogen-containing anionic surfactants.

The surfactant is preferably present at a level of from 2 to 50 wt. %, especially from 5 to 25 wt. % of the cleansing composition. The moisturizing agent is preferably present at from 0.5 to 35 wt. %, especially from 2 to 20 wt. %, particularly from 2 to 8 wt. %.

Further additional ingredients which may be employed include preservatives, pH adjusting agents such as citric acid and sodium hydroxide, perfumes, dyes, suspending agents such as magnesium/aluminum silicate, and sequestering agents such as EDTA.

The cleansers used in the present invention may be shower gels such as those sold under the following brand names: Dove Moisturizing Body Wash, Caress Moisturizing Body Wash, and Lever 2000 Moisturizing Body Wash.

Although the polymeric material of which the looped filament sponge or implement of the invention is made may be inherently mildly abrasive to the skin, it preferably does not incorporate abrasive particles or a scouring material. Thus, abrasives such as pumice, aluminum oxide, volcanic ash, and silica are preferably omitted. Surfactants which are so harsh that they are not typically used for products designed to wash the skin are best avoided in compositions according to the present invention. Likewise, the looped filament sponge should not be ammonia- or oxygen-releasing and preferably does not include bleaching materials.

EXAMPLE 1 (Prophetic)

The implement of FIG. 5 made of polyethylene is packaged together with a separate cleansing agent including cleaning and moisturizing ingredients set forth below to form a system. None of the cleansing agent is impregnated or otherwise initially incorporated into the implement. In one trial, the system is used by placing the washing and moisturizing agent onto the skin of the person washing and then scrubbing with the implement. In a second trial, the cleansing agent is placed on the looped filament sponge and then scrubbing is carried out.

| Full Chemical Name or CTFA Name | % Active Level in Formulation | Tradename and Active |
|---|---|---|
| Water | to100.00 | Deionized Water |
| Cocamidopropyl Betaine | 8.0 | Tegobetaine F @ 30% (ex. Goldschmidt) |
| Sodium Cocoyl Isethionate | 5.0 | Jordapon CI-ADH @ 86% |
| Dimethicone/Laureth-4/Laureth-23 | 5.0 | Dow Q2-1656 (505) Silicone Emulsion |
| Sodium Laureth Sulfate | 2.0 | Stadapol ES-3 @ 28% |
| Ammonium Sulfate | 1.25 | Ammonium Sulfate @ 100% |
| Fragrance | 0.6 | |
| Mica/Titanium Dioxide | 0.2 | Timiron MP-30 @ 100% |
| DMDM Hydantoin | 0.2 | Glydant XL 1000 @ 100% |
| BH | 0.0075 | BHT @ 100% |
| Guar Hydroxypropyl-trimonium Chloride | 0.1 | Jaguar 13S @ 100% |

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A personal washing system comprising a surfactant-based cleanser suitable for personal washing and a washing implement including looped filaments wherein said loops are attached at one end other than by a pile fabric to other looped filaments and free at the other.

2. The washing system according to claim 1 wherein the filaments have a rod-shaped cross section.

3. The washing system according to claim 1 wherein the filaments are polymeric.

4. The washing system according to claim 1 wherein the filaments are non-rubber.

5. The washing system according to claim 1 wherein the filaments are floppy.

6. The washing system according to claim 1 wherein the washing implement forms substantially a sphere having a center and a periphery and said filaments are fastened to each other at the center of the sphere and free at the periphery of the sphere.

7. The washing system according to claim 1 further comprising a base other than a pile fabric, said filaments being also attached to said base.

8. The washing system according to claim 1 further comprising a skin moisturizing ingredient in said cleanser.

9. The washing system according to claim 1 wherein said surfactant is a salt of a fatty acid.

10. The washing system according to claim 1 wherein said surfactant is directly esterified isethionate.

11. The washing system according to claim 1 wherein said cleanser is a liquid cleanser.

12. The personal washing system according to claim 1 wherein said filaments are microtextured.

13. A washing system comprising a surfactant-based cleanser and a washing implement including circular loops of filament, said loops being at least 0.25 cm in diameter attached at one end to other looped filaments and free at the other.

14. The washing system according to claim 13 wherein said circular loops are rod-shaped in cross section.

15. The washing system according to claim 14 wherein said cleanser is a liquid or semi-liquid cleanser.

16. A washing implement comprising an essentially one dimensional base, a plurality of loops having two opposite ends, each loop being attached to at least one other loop at one of said ends and being free at said opposite end said loops also being attached to said base.

17. The washing implement according to claim 16 wherein said base is curved.

18. The washing implement according to claim 16 wherein said implement further comprises an endless ring and said base is wound around said ring.

* * * * *